252-99 AU 166 EX
6/8/82 XR 4,333,771

United States Patent [19]

Altenschöpfer et al.

[11] 4,333,771

[45] Jun. 8, 1982

[54] DETERGENT COMPOSITION WITH A MECHANICAL CLEANING EFFECT

[75] Inventors: Theodor Altenschöpfer, Dusseldorf; Klaus Schumann, Erkrath; Dieter Grodau, Hilden, all of Fed. Rep. of Germany

[73] Assignee: Henkel Kommanditgesellschaft auf Aktien (Henkel KGaA), Dusseldorf-Holthausen, Fed. Rep. of Germany

[21] Appl. No.: 237,063

[22] Filed: Feb. 23, 1981

[30] Foreign Application Priority Data

Feb. 27, 1980 [DE] Fed. Rep. of Germany ..... 3007320

[51] Int. Cl.[3] ..... B08B 3/04; B08B 7/02; C11D 3/12; C11D 3/14

[52] U.S. Cl. ..... 134/7; 51/317; 252/90; 252/99; 252/140; 252/155; 252/174; 252/174.14; 252/174.21; 252/174.25; 252/179

[58] Field of Search ..... 51/317; 134/7; 252/89.1, 99, 140, 154, 155, 160, 174, 174.14, 174.21, 174.25, 90, 179

[56] References Cited

U.S. PATENT DOCUMENTS

| | | | |
|---|---|---|---|
| 3,183,120 | 5/1965 | Mori | 134/7 |
| 4,071,377 | 1/1978 | Schwuger | 134/29 |
| 4,184,975 | 1/1980 | Krings | 252/140 |
| 4,230,593 | 10/1980 | Wagner | 252/179 |
| 4,231,887 | 11/1980 | Denny | 252/174.19 |
| 4,249,903 | 2/1981 | Smolka | 8/137 |
| 4,261,941 | 4/1981 | Sherman | 264/117 |
| 4,288,340 | 9/1981 | Dankworth | 252/99 |

*Primary Examiner*—Dennis L. Albrecht
*Attorney, Agent, or Firm*—Hammond & Littell, Weissenberger and Muserlian

[57] ABSTRACT

A detergent composition with a mechanical cleaning effect for the mechanical cleaning of hard surfaces, particularly cooking and baking utensils, comprising a mixture of granular particles consisting substantially of (A) a powdered to granulated component of conventional mechanical dishwasher washing agents capable of rapidly dissolving or finely dispersing in water, and (B) a granulated component comprising finely divided, water-insoluble inorganic compounds having a particle size between dust fineness and 100 $\mu$, particularly under 10 $\mu$, granulated to a grain size of from 0.2 to 4 mm, preferably from 0.4 to 2 mm, and having a granular stability, as determined according to the method indicated in the disclosure, of a half value of $\frac{1}{4}$ to 3 and an end value of not more than 15%.

13 Claims, No Drawings

DETERGENT COMPOSITION WITH A MECHANICAL CLEANING EFFECT

BACKGROUND OF THE INVENTION

While the cleaning of dishes, glasses and cutlery and the removal of food residues by means of the conventional mechanical dishwashers and the detergents offered by the trade generally does not present any special problems, considerable difficulties are sometimes encountered with dried-on or special food residues, such as dried starch residues. Beyond that, it is frequently not possible in commercial enterprises, like restaurants, company canteens, hospitals, large bakeries or food factories to clean pots, pans, baking molds, etc., with baked-on food residues mechanically in the same manner. The water temperatures and water turbulences in these machines in connection with the chemical action of the conventional detergents are not sufficient to detach such firmly adhering residues from their base.

Presently known methods use, therefore, either suspended sand alone or inert granular material together with a dissolved conventional detergent. As an inert granular material have been suggested, for example, coarse particles of calcium carbonate, magnesium carbonate, but also small metal balls. But these methods require necessarily cleaning of the waste water, that is, removal of the coarse particles, or recovery of the metal balls, used as cleaning agents adjunctives.

OBJECTS OF THE INVENTION

An object of the present invention is the development of a detergent composition with a mechanical cleaning effect for the mechanical cleaning of hard surfaces, which contains a slowly disintegrating granular material which need not be recovered and which does not adversely effect waste water disposal.

A further object of the present invention is the development of a detergent composition with a mechanical cleaning effect for the mechanical cleaning of hard surfaces, particularly cooking and baking utensils, comprising a mixture of granular particles consisting substantially of (A) a powdered to granulated component of conventional mechanical dishwasher washing agents capable of rapidly dissolving or finely dispersing in water, and (B) a granulated component comprising finely divided, water-insoluble inorganic compounds having a particle size between dust fineness and 100μ, particularly under 10μ, granulated to a grain size of from 0.2 to 4 mm, preferably from 0.4 to 2 mm, and having a granular stability, as determined according to the method indicated in the disclosure, of a half value of ¼ to 3 and an end value of not more than 15%.

A yet further object of the present invention is the development of an improvement in a method for cleaning hard surfaces of cooking utensils in a mechanical dishwasher comprising the steps of subjecting the dirty surfaces of cooling utensils to the action of a pressurized washing solution containing conventional water-soluble to water-dispersible detergent components and a granulated component capable of a mechanical scrubbing action for a time sufficient to cleanse said dirty surfaces, rinsing said cleansed cooking utensils and recovering cleaned cooking utensils, the improvement consisting of using a granulated component comprising finely divided, water-insoluble inorganic compounds having a particle size between dust fineness and 100μ, particularly under 10μ, granulated to a grain size of from 0.2 to 4 mm, preferably from 0.4 to 2 mm, and having a granular stability, as determined according to the method indicated in the disclosure, of a half value of ¼ to 3 and an end value of not more than 15%, as said granulated component, wherein said granulated component breaks down to a finely-divided, water-insoluble component during the washing process.

These and other objects of the present invention will become more apparent as the description thereof proceeds.

DESCRIPTION OF THE INVENTION

The subject matter of the present invention is a mechanically applicable detergent for hard surfaces which acts both mechanically and chemically and, therefore, cleans firmly-adhering residues, particularly on cooking and baking utensils, without problems, and without the disadvantages of the detergents of the state of the art.

The detergent consists of a mixture of granulated portions and contains substantially:

(A) a powdered to granulated component of conventional, mechanical dishwasher washing agents capable of rapidly dissolving or rapidly finely-dispersing in water, and (B) a granulated component composed of finely-divided, water-insoluble inorganic compounds having a particle size between dust fineness and 100μ, particularly under 10μ, granulated to a grain size of 0.2 to 4 mm, preferably 0.4 to 2 mm and having a grain stability determined according to the method indicated below with a half-value of ¼ to 3, and an end value of not more than 15%.

More particularly, the present invention relates to a detergent composition with a mechanical cleaning effect for the mechanical cleaning of hard surfaces, particularly cooking and baking utensils, comprising a mixture of granular particles consisting substantially of (A) a powdered to granulated component of conventional mechanical dishwasher washing agents capable of rapidly dissolving or finely dispersing in water, and (B) a granulated component comprising finely divided, water-insoluble inorganic compounds having a particle size between dust fineness and 100μ, particularly under 10μ, granulated to a grain size of from 0.2 to 4 mm, preferably from 0.4 to 2 mm, and having a granular stability, as determined according to the method indicated in the disclosure, of a half value of ¼ to 3 and an end value of not more than 15%. In addition, the invention also relates to an improvement in a method for cleaning hard surfaces of cooking utensils in a mechanical dishwasher comprising the steps of subjecting the dirty surfaces of cooking utensils to the action of a pressurized washing solution containing conventional water-soluble to water-dispersible detergent components and a granulated component capable of a mechanical scrubbing action for a time sufficient to cleanse said dirty surfaces, rinsing said cleansed cooking utensils and recovering cleaned cooking utensils, the improvement consisting of using a granulated component comprising finely divided, water-insoluble inorganic compounds having a particle size between dust fineness and 100μ, particularly under 10μ, granulated to a grain size of from 0.2 to 4 mm, preferably from 0.4 to 2 mm, and having a granular stability, as determined according to the method indicated in the disclosure, of a half value of ¼ to 3 and an end value of not more than 15%, as said granulated component, wherein said granulated component breaks down to a finely divided, water-insoluble component during the washing process.

The grain stability of the granulated component (B) is understood to be the wet grain strength. It is determined as the variation in time of the particle size spectrum, by measuring the reduction of the grain size in a standard measuring instrument which simulates the conditions of the application of the detergent. The measurement is so effected that the reduction of the grain size of the granulate is measured in a moving aqueous suspension at 60° C. during the course of 30 minutes. After 15 and 30 minutes, samples are withdrawn and the reduction of the grain size relative to a screen of 0.4 mm mesh aperture is determined after drying. Suitable granules B in the sense of the invention are thus those whose decellerated disintegration in an aqueous liquor attains at least the value $\frac{1}{4}$, but which have preferably a higher degree of difficult solubility than corresponds to the value 3, and which are preferably completely disintegrated at the end of the test, but have a residue portion of not more than 15% by weight of particles larger than 0.4 mm.

A rapidly water-dissolving or rapidly finely-dispersing powder or granular material according to component (A) is understood to be a powder or granular material which has a half value of clearly under $\frac{1}{3}$ and an end value of practically 0% according to this method of determination.

In the detergent according to the invention, component (A) leads at first, in its application, to the formation of a cleaning liquor for washing dishes in machines, which has the usual alkalinity, surface-activity and activated chlorine activity. Component (B) of the detergent according to the invention, on the other hand, acts at first mechanically on the soil, because of the stability of the granules in the liquor. Depending on the liquor temperature and the mechanism of the machine, this mechanical action of the granules lasts from 5 to 40 minutes, with durations of 10 to 20 minutes being preferred. The mechanical cleaning action of the granules is thus due to their time-limited stability in the cleaning liquor. In the course of the cleaning process in the machine, the granules disintegrate into their water-insoluble, substantially finely-divided components, which are floatable under the operating conditions of the machine and are therefore discharged with the liquor at the end of the cleaning process. It was found that these floatable water-insoluble disintegration products of the granules in the waste water are readily eliminated, and that they represent no burden for the sewer system and clarifying plants. From an ecological point of view, these disintegration products of component (B) can be considered neutral. In continuously working machines, the concentration of the detergent in the cleaning liquor can be kept constant by continuously adding detergent.

The detergents according to the invention can be used both in household and commercial machines for washing dishes, but particularly in so-called pot washing machines or machines with pot washing programs, where it is certain that the mechanically acting component (B) is engaged by the circulating system and circulated in these machines.

The detergent according to the invention contains generally as component (A):

from 10% to 95% by weight of a powder or granular material which consists of condensed alkali metal phosphates and/or water-soluble or water-insoluble phosphate substitutes, alkali metal silicates, as well as, optionally, compounds giving off active chlorine, nonionic tensides, alkali metal hydroxides, alkali metal carbonates and other customary ingredients of dishwasher detergents, and as component (B):

from 5% to 90% by weight of a granulated material of finely-divided, water-insoluble, inorganic compounds, particularly from the group of the alkali metal and alkaline earth aluminosilicates, as well as customary inorganic binders. The quantitative ratio of component (A) to component (B) is from 8:1 to 1:8, preferably from 3:1 to 1:3.

As the essential ingredient of component (B), the synthetically produced, crystalline alkali metal aluminosilicates, particularly the sodium aluminosilicates with water-softening properties, that is, those with a calcium-binding power of at least 20, preferably at least 50 mg CaO/gm of the anhydrous aluminosilicate, are preferably used. Of the conventional inorganic binders for preparing granulated material, sodium silicates or amorphous sodium aluminosilicates formed of sodium silicate and alkali metal aluminate during the granulation step are preferred. Such granulates and their production are described in U.S. Pat. No. 4,249,903.

From the viewpoint of effective ion-exchanger properties, crystalline sodium aluminosilicates, which are known in the industry as zeolite A, zeolite X, zeolite HS or zeolite P, and mixtures of these zeolites with each other, are preferred. Particularly preferred because of its good ion-exchanging and detergent builder properties and its readily technical availability is zeolite A with a particle size distribution substantially in the range of 1 to 10$\mu$, where practically no particles over 40$\mu$ are present, and the lower range can extend down to dust fineness, or down to 0.1$\mu$.

The preferred granular materials consist, therefore, of the finely divided cation-exchanging, crystalline sodium aluminosilicates, which are preferably held together by amorphous sodium aluminosilicate as a binder. Such an amorphous aluminosilicate formed in situ from sodium silicate and sodium aluminate has the advantage that it has itself ion-exchanging properties. Such granular materials composed of cation-exchanging components enhance the cleaning process, in addition to their mechanical action, due to their calcium-binding power, since they contribute to the softening of the cleaning liquor and loosen up calcium/magnesium-containing soil-substances by absorbing the calcium and magnesium ions from this soil, thus facilitating the cleaning process.

Effective granular materials according to component (B) can principally also be obtained from other finely-divided, water-insoluble inorganic substances, such as calcium oxide, calcium hydroxide or calcium carbonate. These granular materials also have a cleaning effect on coarse soil and cause no waste water problems after their disintegration; but they contain the hardness formers of water and are, therefore, harmful for the entire mechanical cleaning process.

According to a general formulation, the detergents according to the invention consist of a mixture of (A) from 10% to 95%, preferably from 40% to 70% by weight of a water-soluble, powdered or granulated detergent component with a content of (1) from 20% to 60%, preferably from 30% to 45% by weight of a water-soluble condensed alkali metal phosphate, which can be replaced up to 30% to 50% of its weight by a water-dispersible, finely-divided, synthetically-produced crystalline alkali metal aluminosilicate, (2) from 10% to 50%, preferably from 25% to 45% by weight of a water-soluble alkali metal silicate, (3) from 2% to 20%, preferably from 4% to 10% by weight of a waterglass, (4) from 0 to 10%, preferably from 2% to 5% by weight of a compound giving off active chlorine, (5) from 0 to 5%, preferably from 1% to 3% by weight of a low-sudsing, nonionic tenside, (6) from 0 to 50%, preferably from 5% to 20% by weight of an alkali metal hydroxide and/or alkali metal carbonate, (7) from 0 to 10%, preferably from 0.5% to 5% by weight of other customary ingredients, and (8) from 1% to 30%, preferably from 1% to 15% by weight of water, and (B) from 5% to 90%, preferably from 30% to 60% by weight of a granular material with a grain size of 0.2 to 4.0 mm, preferably 0.4 to 2.0 mm, and a grain stability as defined above, consisting of (9) from 80% to 95%, preferably from 85% to 90% by weight of a synthetically produced, crystalline sodium aluminosilicate with a particle size of 0.1 to 100μ, and

(10) from 5% to 20%, preferably from 10% to 15% by weight of a binder selected from the group consisting of waterglass, amorphous alkali metal aluminosilicates and mixtures thereof.

Suitable granular materials can be produced, for example, in analogy to the methods described in U.S. Pat. No. 3,356,450 or German published applications DOS No. 22 33 070 or DOS No. 25 24 484 or U.S. Pat. No. 4,058,586. The desired grain size of these granular materials is obtained, if necessary, by screen fractioning. However, other production methods are also conceivable.

COMPONENT (A)

Suitable condensed phosphates in the sense of the invention are the water-soluble alkali metal diphosphates or triphosphates or the water-soluble alkali metal hexametaphosphates. The water-soluble alkali metal silicates are preferably sodium or potassium silicates, where the molar ratio of silicon dioxide to alkali metal oxide is 2:1 to 1:3.5.

The waterglasses are sodium or potassium waterglasses with 30% to 55% by weight silicate, where the molar ratio of silicon dioxide to alkali metal oxide can be over 2:1 to 3.5:1. These waterglasses, unless stated otherwise, are used in the usual form of concentrated aqueous solutions.

Compounds giving off active chlorine are preferably trichloroisocyanuric acid and the alkali metal salts of dichloroisocyanuric acid or their hydrates, such as potassium or sodium dichloroisocyanurate. Alkali metal hypochlorites, such as lithium or sodium hypochlorite, as well as chlorinated phosphates, can likewise be used.

The water-soluble or water-insoluble phosphate substitutes for a partial or complete replacement of the condensed phosphates of component (A) are organic or inorganic builder compounds, which have a sequestering or ion-exchanging effect on the hardness formers of the water. Preferred is the use of water-insoluble, finely-divided, cation-exchanging sodium aluminosilicates together with a reduced amount of phosphates according to the teaching of U.S. Pat. No. 4,071,377. According to this disclosure, the cation-exchanging aluminosilicates can also be used in component (A), just as in component B, but in the original, finely-divided and readily dispersible form.

In order to improve the wetting action of the mixtures, low-sudsing, nonionic tensides can be added. These are preferably ethylene oxide adducts onto higher molecular weight polyoxypropylene glycols with molar weights of 900 to 4000, as well as adducts of ethylene oxide or ethylene oxide and propylene oxide onto higher fatty alcohols, such as dodecyl alcohol, palmityl alcohol, stearyl alcohol, oleyl alcohol and mixtures thereof, as well as synthetic alkanols of the chain lengths $C_{12}$–$C_{18}$, produced, for example, by oxosynthesis, as well as corresponding alkylene oxide adducts onto nonyl phenol. Their production is effected in the known manner by reacting the respectively alkylene oxides in the presence of alkaline catalysts, if necessary under pressure and at elevated temperatures, where up to a three-fold amount by weight of the alkylene oxides are added per weight of the starting compounds. An example of a suitable adduct is an addition product of ethylene oxide onto a polypropylene glycol ether, known under the trade name "Pluronic L 61", with a molecular weight of 1900, where the portion of the polypropylene glycol ether is 90% by weight and the portion of the polyethylene glycol ether is 10% by weight.

The other customary ingredients of dishwashing detergents incorporated into component (A) especially include enzymes. Suitable enzymes are obtained from animal or vegetable materials, particularly from digestive ferments, yeasts and bacteria strains. They represent mostly a complex mixture of various enzymatic substances. Of particular interest are enzymes breaking down starch, protein or fat, such as amylases, proteases and lipases. The enzymes are obtained according to various methods from bacteria strains, fungi, yeasts or animal organs. Mostly these are enzyme mixtures which have a combined effect, particularly on starch and protein. The enzyme preparations obtained from *bacillus subtilis* are relatively resistant to alkalis and are not yet markedly inactivated at temperatures between 45° and 70° C., so that they are particularly suitable for use in the detergents according to the invention.

COMPONENT (B)

The water-insoluble, finely-divided aluminosilicates are generally compounds, containing bound water, of the general formula $$(Cat_2O)_x.Al_2O_3.(SiO_2)_y,$$

where Cat denotes an alkali metal or alkaline earth ion, particularly the sodium ion, x is a number from 0.7 to 1.5, and y is a number from 0.8 to 6, with a calcium-binding capacity of at least 20, preferably at least 50 to 200 mg CaO/gm of anhydrous active substance, whose particle size is in the range of from about 0.1 to 100μ. The crystalline alkali metal aluminosilicates which can be used are the zeolites A, X, HS and P, particularly zeolite A in the particle size range suitable for use in detergents.

Preferred is sodium aluminosilicate of the type zeolite A, which is sold under the name SASIL ® by Henkel KGaA, Dusseldorf, Germany.

The binders for the building up of the finely-divided floatable particles to larger granules which disintegrate in water, are generally waterglass, clays, bentonites, silica gels and alumina gels. These binders, however, have practically no ion-exchanging power of their own.

Preferred binders are the amorphous sodium aluminosilicates formed in situ during the granulation step. These granules, obtained by the appropriate reaction conditions and mixing ratios of the binder substances during the granulation or spray-drying, have a limited grain stability in the machines under the conditions of the cleaning process. The stability properties of the granular material and the calcium-binding capacity are determined as indicated below:

DETERMINATION OF GRAIN STABILITY

In a test apparatus, consisting of an oblong box (30×27×19 cm; L×B×H) of 10 liters capacity with a funnel-shaped bottom (27×19×10 cm) and angles of inclination of 40° and 50° respectively as well as a curved pipe as a discharge for the liquor, the latter is circulated over a circulating pump, model Miele G 5/Mpe 66/2/1 with an output of about 150 l/min. The liquor enters through a spray arm pipe system, model Lepper-Matura (length=10 cm). Compared to the standard model, this system has been expanded by two nozzles. Above the spray arm, in a distance of 5 cm, is arranged a baffle surface with a diameter of 11 cm. The pump pressure is 1.2 bar.

For the measurements, 50 gm of component (B) are placed in 10 liters of softened water of 60° C. and circulated in the test apparatus. Two sample aliquots each are withdrawn after test periods of 15 minutes and 30 minutes, respectively, and filtered off through a membrane filter. The filter residue is dried for 24 hours at 130° C. The dried granules are screened through an 0.4 mm screen, and separated into portions of over and under 0.4 mm. In order to determine the grain stability, the quotient of the granular mass over 0.4 mm and of the granular mass under 0.4 mm is determined in the 15-minute sample, and this value represents the half value. The amount of granulated material determined on the 0.4 mm screen in the 30-minute sample is expressed in % by weight and indicated as the end value of the test.

DETERMINATION OF CALCIUM-BINDING CAPACITY 1 liter of an aqueous solution containing 0.594 gm of $CaCl_2$ (=300 mg CaO/l=30°dh) and adjusted with diluted NaOH to a pH-value of 10, is mixed with 1 gm of alkali metal aluminosilicate (anhydrous active substance AS). Then the suspension is stirred vigorously for 15 minutes at a temperature of 22° C. (±2° C.). After filtering off the alkali metal aluminosilicate, the residual hardness x of the filtrate is determined, from which the calcium-binding capacity is calculated in mg CaO/gm AS according to the formula (30−x)0.10.

The following examples are illustrative of the invention without being limitative thereof.

EXAMPLE 1

A fully water-soluble granular dishwater detergent (A) of a grain size of about 0.5 to 1.0 mm, which corresponds to commercial products, was produced in known manner and had the following composition:

(A)

45.0% by weight of sodium triphosphate
30.0% by weight of sodium metasilicate (anhydrous)
7.5% by weight of waterglass ($SiO_2$: $NaO_2$=3.3:1 (35% aqueous solution)
4.5% by weight of sodium carbonate (anhydrous)
10.0% by weight of sodium hydroxide
3.0% by weight of sodium dichloroisocyanurate This granular component (A) was mixed in a ratio of 1:1, with a granular component (B) which was brought by screen separation to a mean grain size of about 0.5 mm and had the following composition:

(B)

90.0% by weight of zeolite A
10.0% by weight of binder, consisting of a mixture of waterglass and amorphous sodium aluminosilicate, with a ratio of $SiO_2$: $Al_2O_3$ of 2.3.

The zeolite A used was a sodium aluminosilicate of the following composition:

$$0.99\ Na_2O.1.00\ Al_2O_3.1.83\ SiO_2.4.0\ H_2O\ (=20.9\%\ \text{by weight}),$$

with a mean particle diameter of the rounded cubic crystals of 5.4μ (for the range under 30μ) and a calcium-binding capacity of 172 mg CaO/gm, based on the anhydrous substance.

For the production of the granular component (B), 25 kg of zeolite A (mean particle size 4 to 5μ) and 2.5 kg of $NaAlO_2$ were mixed intensively in a counterflow-mixer of the Eirich-MPM-type. A mixture of 11 kg of waterglass (27/40) and 7.8 kg of deionized water was then sprayed through a nozzle on the zeolite/aluminate mixture, with intervals of spraying for 5 minutes and mixing for 5 minutes. The granular material was dried overnight at 110° C.

In the determination of the grain stability, the particle spectrum was determined and given in the following Table I. The particle size was determined with a set of screens according to DIN 4188.

TABLE I

| Time | % portion on screen | | | | | | |
|---|---|---|---|---|---|---|---|
| min. | >1.6 | 0.8 | 0.4 | 0.2 | 0.1 | 0.05 | <0.05 |
| 0 | 22 | 28 | 47 | 3 | — | — | — |
| 5 | 8 | 19 | 54 | 15 | 3 | 1 | — |
| 15 | 1 | 12 | 41 | 28 | 14 | 4 | — |
| 20 | — | 4 | 23 | 49 | 21 | 3 | — |
| 30 | — | — | 5 | 19 | 55 | 19 | 2 |

The granulated material thus had a half value of 1.2 and an end value of 5%.

Other granular sodium aluminosilicates similar to the above are disclosed in U.S. Pat. No. 4,249,903, incorporated herein by reference.

EXAMPLE 2

A mixture of one part component (A) and three parts component (B) was produced in analogy to Example 1.

EXAMPLE 3

A mixture of one part component (A) and seven parts component (B) was produced in analogy to Example 1.

EXAMPLE 4

The cleaning action of the granular material according to the invention was tested in a test apparatus, which corresponded substantially to a dishwashing machine, as is described in German Published Application DOS No. 26 00 088. The cleaning liquor stirred with a high-speed stirrer is sucked in from a storage vessel of 10 liter capacity and sprayed vigorously on the surface to be cleaned by means of a compressed air-diaphragm pump with an output of 100 l/min. through a pipe of 10 cm length provided with several orifices. The soil employed was a stubborn milk stain which was obtained by concentrating milk in several stages in glass dishes on an oil bath at 200° C. The test apparatus was charged first with water of 50° C. In the course of the cleaning process it was heated to 60° C.

For comparison, a commercial detergent of the following composition was also subjected to this test:

Comparison Detergent 45.0% by weight of sodium triphosphate
32.0% by weight of sodium metasilicate, anhydrous
2.2% by weight of sodium dichloroisocyanurate dihydrate
1.0% by weight of nonionic tenside
10.4% by weight of sodium carbonate
9.4% by weight of water As expected, this detergent was already completely dissolved in the liquor after 5 minutes, and thus could not be used in an abrasive manner in the sense of the invention.

The results of the cleaning tests are compiled in the following Table II. The cleaning power was graded between "practically non-existent" and "very good", using the symbol o, +, ++, +++. Comparable results were also obtained when zeolite A in component (B) of Example 1 was replaced partly or completely by zeolites X, HS or P.

TABLE II

Cleaning Action on Glass Dishes Soiled with Burnt Milk

| Cleaning action after minutes | 1 | 2 | 3 | 4 | 5 |
|---|---|---|---|---|---|
| City water | o | o | o | + | + |
| Sea sand (0.1–0.3 mm; 3 gm/l) | + | + | + | + | + |
| Phosphate-containing cleanser (comparison; 3 gm/l) | + | + | ++ | ++ | ++ |
| 1:1 mixture of sea sand and phosphate-containing cleanser (comparison; 3 gm/l) | ++ | ++ | ++ | ++ | ++ |
| 1:1 mixture of SASIL-containing granules and phosphate-containing cleanser (Example 1; 3/gm/l) | ++ | ++ | ++ | ++ | +++ |
| 3:1 mixture of SASIL-containing granules and phosphate-containing cleanser (Example 2; 3 gm/l) | ++ | ++ | ++ | ++ | +++ |
| 7:1 mixture of SASIL-containing granules and phosphate-containing cleanser (Example 3; 3 gm/l) | ++ | ++ | ++ | +++ | +++ |

The tests clearly show that in the case of particularly stubborn stains, a certain cleaning effect is already achieved under the influence of the mechanism of the water. Sea sand brought a slight improvement. As expected, the cleaning was improved by a conventional granular phosphate containing detergent or a detergent mix with components like triphosphate and metasilicate.

In a combination of sea and phosphate-containing detergents, the cleaning power on stubborn stains was slightly improved.

With the detergents according to the invention, in each case better results were achieved than with the combination of sea sand and phosphate-containing detergent.

EXAMPLE 5

The cleaning power was also tested on stained pot bottoms in a remodeled commercial one-tank-dishwashing machine with a funnel-shaped vat bottom. The cleaning results on pot bottoms with particularly stubborn stains of burnt milk and burnt fried fresh pork liver are compiled in the following Table III. In can be seen quite clearly that the detergents according to the invention lead to good results in a much shorter time than the commercial products.

TABLE III

Cleaning Tests in a Remodeled Commercial One-Tank Dishwashing Machine; Cleaning Temperature 60° C.

| | Cleaning Power in Points After | |
|---|---|---|
| Milk Stain | | |
| t(minutes) | 2–5 | 8–12 |
| City water | No complete cleaning | |
| Commercial phosphate-containing detergent (3 gm/l) | No complete cleaning | Complete cleaning |
| Detergent according to the invention (Example 1, 3 gm/l) | Complete cleaning | — |
| Liver Stains | | |
| t(minutes) | 4–8 | 10–20 |
| City water | No complete cleaning | |
| Commercial phosphate-containing detergent (3 gm/l) | No complete cleaning | Complete cleaning |
| Detergent according to the invention (Example 1, 3 gm/l) | Complete cleaning | — |

The preceding specific embodiments are illustrative of the practice of the invention. It is to be understood, however, that other expedients known to those skilled in the art or disclosed herein, may be employed without departing from the spirit of the invention or the scope of the appended claims.

We claim:

1. A detergent composition with a mechanical cleaning effect for the mechanical cleaning of hard surfaces, particularly cooking and baking utensils, comprising a mixture of granular particles consisting substantially of (A) a powdered to granulated component of conventional mechanical dishwasher washing agents capable of rapidly dissolving or finely dispersing in water, and (B) a granulated component comprising finely divided, water-insoluble inorganic compounds having a particle size between dust fineness and 100$\mu$, granulated to a grain size of from 0.2 to 4 mm, and having a granular stability, as determined according to the method indicated in the disclosure, of a half value of $\frac{1}{4}$ to 3 and an end value of not more than 15% particles having a size of over 0.4 mm.

2. The detergent composition of claim 1 wherein component B was a granulated component comprising finely divided, water-insoluble inorganic compounds having a particle size between 0.1 and 10$\mu$, granulated to a grain size of from 0.4 to 2 mm.

3. The detergent composition of claim 1 or 2 wherein it contains as component (A) from 10% to 95% by weight of a powdered to granular material which consists of a mixture of condensed alkali metal phosphates and/or water-soluble or water-insoluble phosphate substitutes, alkali metal silicates, as well as, optionally, compounds giving off active chlorine, nonionic tensides, alkali metal hydroxides, alkali metal carbonates and other customary dishwasher detergent components, and as component (B) from 5% to 90% by weight of a granulated material derived from finely-divided, water-insoluble, inorganic compounds, selected from the group consisting of alkali metal aluminosilicates and alkaline earth aluminosilicates, as well as customary inorganic binders, where the quantitative ratio of component (A) to component (B) is 8:1 to 1:8.

4. The detergent composition of claim 3 wherein the quantitative ratio of component (A) to component (B) is 3:1 to 1:3.

5. The detergent composition of claim 3 wherein the component (B) inorganic compounds are crystalline alkali metal aluminosilicates.

6. The detergent composition of claim 5 wherein said crystalline alkali metal aluminosilicates are crystalline sodium aluminosilicates with water-softening properties.

7. The detergent composition of claim 3 wherein the component (B) inorganic binders are selected from the group consisting of sodium silicates, amorphous sodium aluminosilicates formed from sodium silicate and alkali metal aluminates during granulation, and mixtures thereof.

8. The detergent composition of claim 6 wherein said crystalline sodium aluminosilicate is selected from the group consisting of sodium zeolite A, sodium zeolite X, sodium zeolite HS, sodium zeolite P, and mixtures thereof.

9. The detergent composition of claim 8 wherein said crystalline sodium aluminosilicate is sodium zeolite A having a particle size distribution of from about 1 to 10μ.

10. A detergent composition with a mechanical cleaning effect for the mechanical cleaning of hard surfaces, particularly cooking and baking utensils, comprising a mixture of granular particles consisting substantially of a mixture of (A) from 10% to 95% by weight of a water-soluble powdered to granulated component of conventional mechanical dishwasher washing agents capable of rapidly dissolving in water, having a content of (1) from 20% to 60% by weight of a water-soluble, condensed alkali metal phosphate, which can be replaced with up to 30% to 50% of its weight by a water-dispersible, finely-divided, synthetically produced crystalline alkali metal aluminosilicate, (2) from 10% to 50% by weight of a water-soluble alkali metal silicate, (3) from 2% to 20% by weight of a waterglass, (4) from 0 to 10% by weight of a compound giving off active chlorine, (5) from 0 to 5% by weight of a low-sudsing nonionic tenside, (6) from 0 to 50% by weight of an alkali selected from the group consisting of an alkali metal hydroxide, an alkali metal carbonate and mixtures thereof, (7) from 0 to 10% by weight of other conventional dishwasher detergent ingredients, and (8) from 1% to 30% by weight water, and (B) from 5% to 90% by weight of a granulated component comprising finely-divided, water-insoluble inorganic compounds having a particle size between 0.1 and 100μ, granulated to a grain size of from 0.2 to 4 mm and having a granular stability, as determined according to the method indicated in the disclosure, of a half value of ¼ to 3 and an end value of not more than 15% particles having a size of over 0.4 mm, consisting of (9) from 80% to 95% by weight of a synthetically produced crystalline sodium aluminosilicate with a particle size of from 0.1 to 100μ, and

(10) from 5% to 20% by weight of a binder selected from the group consisting of waterglass, amorphous alkali metal aluminosilicates, and mixtures thereof.

11. The detergent composition of claim 10 wherein, component (A) is present in an amount of from 40% to 70% by weight and, in component (A), component (1) is present in an amount of from 30% to 45% by weight, component (2) is present in an amount of from 25% to 45% by weight, component (3) is present in an amount of from 4% to 10% by weight, component (4) is present in an amount of from 2% to 5% by weight, component (5) is present in an amount of from 1% to 3% by weight, component (6) is present in an amount of from 5% to 20% by weight, component (7) is present in an amount of from 0.5 to 5% by weight component (8) is present in an amount of from 1% to 15% by weight and component (B) is present in an amount of from 30% to 60% by weight and, in component (B), component (9) is present in an amount of from 85% to 90% by weight, and component (10) is present in an amount of from 10% to 15% by weight.

12. In a method for cleaning hard surfaces of cooking utensils in a mechanical dishwasher comprising the steps of subjecting the dirty surfaces of cooking utensils to the action of a pressurized washing solution containing conventional water-soluble to water-dispersible detergent components and a granulated component capable of a mechanical scrubbing action, for a time sufficient to cleanse said dirty surfaces, rinsing said cleansed cooking utensils and recovering cleaned cooking utensils, the improvement consisting of using a granulated component comprising finely-divided, water-insoluble inorganic compounds having a particle size between dust fineness and 100μ, granulated to a grain size of from 0.2 to 4 mm, and having a granular stability, as determined according to the method indicated in the disclosure, of a half value of ¼ to 3 and an end value of not more than 15% particles having a size of over 0.4 mm, as said granulated component, wherein said granulated component breaks down to a finely-divided, water-insoluble component during the washing process.

13. The method of claim 12 wherein said granulated component comprises finely-divided, water-insoluble inorganic compounds having a particle size between 0.1 and 10μ, granulated to a grain size of from 0.4 to 2 mm.

* * * * *